US010843493B2

(12) United States Patent
Sakurai et al.

(10) Patent No.: US 10,843,493 B2
(45) Date of Patent: Nov. 24, 2020

(54) IMAGE PRINTING APPARATUS, CONTROL METHOD THEREFOR, AND PRINT MEDIUM DISCHARGING APPARATUS

(71) Applicant: CANON KABUSHIKI KAISHA, Tokyo (JP)

(72) Inventors: Norio Sakurai, Tokyo (JP); Yuki Emoto, Tokyo (JP); Toshiaki Somano, Tokyo (JP); Kosuke Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/423,354

(22) Filed: May 28, 2019

(65) Prior Publication Data

US 2019/0366742 A1 Dec. 5, 2019

(30) Foreign Application Priority Data

May 31, 2018 (JP) ..... 2018-104693

(51) Int. Cl.
*B41J 13/10* (2006.01)
*B41J 11/00* (2006.01)
*B65H 33/08* (2006.01)

(52) U.S. Cl.
CPC ..... *B41J 13/106* (2013.01); *B41J 11/0095* (2013.01); *B65H 33/08* (2013.01)

(58) Field of Classification Search
CPC ..... B65H 33/08
See application file for complete search history.

(56) References Cited

U.S. PATENT DOCUMENTS 6,142,469 A * 11/2000 Nanba ..... B65H 31/10 270/52.03
6,378,864 B1 * 4/2002 Iesaka ..... B65H 29/22 271/202
6,634,640 B1 * 10/2003 Yoshizawa ..... B65H 31/22 271/213

(Continued)

FOREIGN PATENT DOCUMENTS

JP 2002167119 A * 6/2002
JP 2004210527 A * 7/2004
JP 2006-137610 A 6/2006

OTHER PUBLICATIONS

U.S. Appl. No. 16/423,361, filed May 28, 2019 (First Named Inventor: Yuki Emoto).

(Continued)

*Primary Examiner* — Shelby L Fidler
(74) *Attorney, Agent, or Firm* — Venable LLP

(57) ABSTRACT

An image printing apparatus includes a print unit, a tray moving unit that moves a tray for receiving a print medium discharged in a first direction, in a second direction crossing the first direction, a lever moving unit that moves a lever that contacts to the print medium stacked on the tray and is rotatable according to an amount of stacking between a first position at which the lever is contactable to the stacked print medium and a second position at which the lever is separated from the stacked print medium. A control unit causes the tray moving unit to move the tray in the second direction in a state in which the control unit has caused the lever moving unit to move the lever to the second position.

19 Claims, 16 Drawing Sheets

(56) References Cited

U.S. PATENT DOCUMENTS

| | | | | |
|---|---|---|---|---|
| 9,359,163 | B1 * | 6/2016 | Miyazaki | B65H 31/26 |
| 2009/0020939 | A1 * | 1/2009 | Tamura | B65H 31/3081 271/3.01 |

OTHER PUBLICATIONS

U.S. Appl. No. 16/416,483, filed May 20, 2019 (First Named Inventor: Toshiaki Somano).
U.S. Appl. No. 16/420,393, filed May 23, 2019 (First Named Inventor: Yuki Emoto).

* cited by examiner

| FIG.15A |
| --- |
| FIG.15B |

IMAGE PRINTING APPARATUS, CONTROL METHOD THEREFOR, AND PRINT MEDIUM DISCHARGING APPARATUS

BACKGROUND OF THE INVENTION

Field of the Invention

The present invention relates to an image printing apparatus and a control method therefor.

Description of the Related Art

Some image printing apparatuses have a capability of aligning a plurality of print medium, sequentially discharged, while sorting the print medium. Japanese Patent Laid-Open No. 2006-137610 discloses a discharge method for aligning print medium at different positions on a discharging tray for receiving the discharged print medium by moving the discharging tray in a horizontal direction with respect to a discharging port.

With regard to the image printing apparatuses, there is known a method of using a lever swingable in a vertical direction with respect to the discharging tray to detect full loading of stacked print medium from a rotational angle of the lever in a case where the tip of the lever contacts a surface of a topmost print medium stacked on the discharging tray.

However, in a case where the discharging tray on which the lever is provided is moved horizontally, as disclosed in Japanese Patent Laid-Open No. 2006-137610, the following concern arises. For example, there is a case where the image printing apparatus shifts to a non-operational state such as power off, sleep, or standby with the tip of the lever contacting on the topmost print medium among the print medium stacked on the discharging tray. At this time, in a case where a user brings out the stack of print medium and then returns the stack of print medium to a position off the lever, the lever may hit a side of the stack of print medium returned in the next movement of the discharging tray in the horizontal direction, so that the side may be damaged or the lever may be damaged. Even in a case where the user returns the print medium to a position where the print medium contacts to the lever, in a case where the position is displaced, the lever may be disengaged from the print medium as the discharging tray moves in the horizontal direction, so that it is still likely that the side of the stack of print medium will be damaged or the lever will be damaged.

Furthermore, hitting of the lever against the side of the stack of print medium causes the alignment position of the print medium to vary, and in a case where the lever is disengaged from the stack of print medium, detection of full loading itself cannot be performed properly.

There is also a similar concern such that the stack of print medium may be misaligned during discharging operation of the image printing apparatus as well as in the non-operational state. In addition, in a case where the discharging tray moves with the tip of the lever being in contact with the topmost surface of the stack of print medium, a print medium near the topmost surface may be misaligned or the printing surface may be contaminated or scratched.

SUMMARY OF THE INVENTION

The present invention has been made to solve the above problems. It is therefore an object of the present invention to provide an image printing apparatus capable of reliably detecting full loading of a discharging tray while adequately performing an operation involving a horizontal movement of the discharging tray such as a discharging process involving sorting.

According to a first aspect of the present invention, there is provided an image printing apparatus comprising: a print unit configured to print an image on a print medium; a tray moving unit configured to move a tray for receiving a print medium on which an image is printed by the print unit and which is discharged in a first direction, in a second direction crossing the first direction; a lever moving unit configured to move a lever that contacts to the print medium stacked on the tray and is rotatable according to an amount of stacking between a first position at which the lever is contactable to the stacked print medium and a second position at which the lever is separated from the stacked print medium; and a control unit configured to control the print unit, the tray moving unit and the lever moving unit, wherein the control unit causes the tray moving unit to move the tray in the second direction in a state in which the control unit has caused the lever moving unit to move the lever to the second position.

According to a second aspect of the present invention, there is provided a control method for an image printing apparatus comprising a print unit configured to print an image on a print medium, a tray configured to receive a print medium on which an image is printed by the print unit and which is discharged in a first direction, and a lever configured to contact to the print medium stacked on the tray and rotatable according to an amount of stacking, the control method comprising: moving the tray in the second direction in a state in which the lever has moved to the second position.

According to a third aspect of the present invention, there is provided a print medium discharging apparatus comprising: a tray moving unit configured to move a tray for receiving a print medium on which an image is printed and which is discharged in a first direction, in a second direction crossing the first direction; a lever moving unit configured to move a lever that contacts to the print medium stacked on the tray and is rotatable according to an amount of stacking between a first position at which the lever is contactable to the stacked print medium and a second position at which the lever is separated from the stacked print medium; and a control unit configured to control the tray moving unit and the lever moving unit, wherein the control unit causes the tray moving unit to move the tray in the second direction in a state in which the control unit has caused the lever moving unit to move the lever to the second position.

Further features of the present invention will become apparent from the following description of exemplary embodiments with reference to the attached drawings.

DESCRIPTION OF THE EMBODIMENTS

First Embodiment

Figure 1:
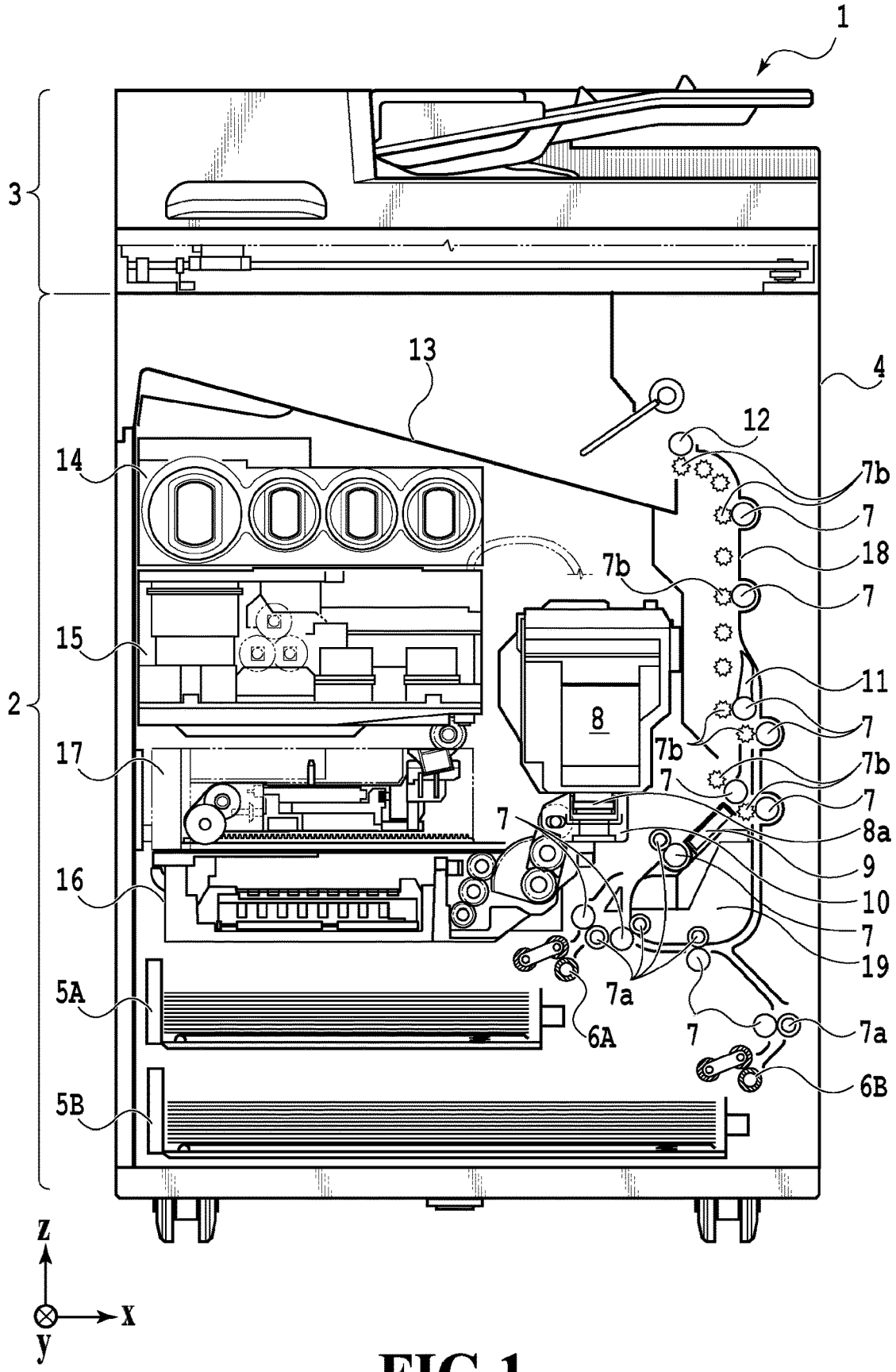
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing print medium (cut sheets) S are detachably provided at the bottom of a casing 4 in the vertical direction. Relatively small print medium of up to A4 size are stacked and housed in the first cassette 5A and relatively large print medium of up to A3 size are stacked and housed in the second cassette 5B. A first feeding unit 6A for feeding housed print medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor. The pinch rollers 7*a* are follower rollers that are turned while nipping a print medium S together with the conveying rollers 7. The discharging roller 12 is a drive roller located downstream of the conveying rollers 7 and driven by a discharging motor. The spurs 7*b* nip and convey a print medium S together with the conveying rollers 7 and discharging roller 12 located downstream of the print head 8 (platen 9).

The printing apparatus 1 is provided with a plurality of motors for driving the drive rollers, each of which is connected to one of the plurality of motors. The correspondence relation between the motors and the drive rollers will be described in detail later.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for receiving, stacking, and housing print medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores inks of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
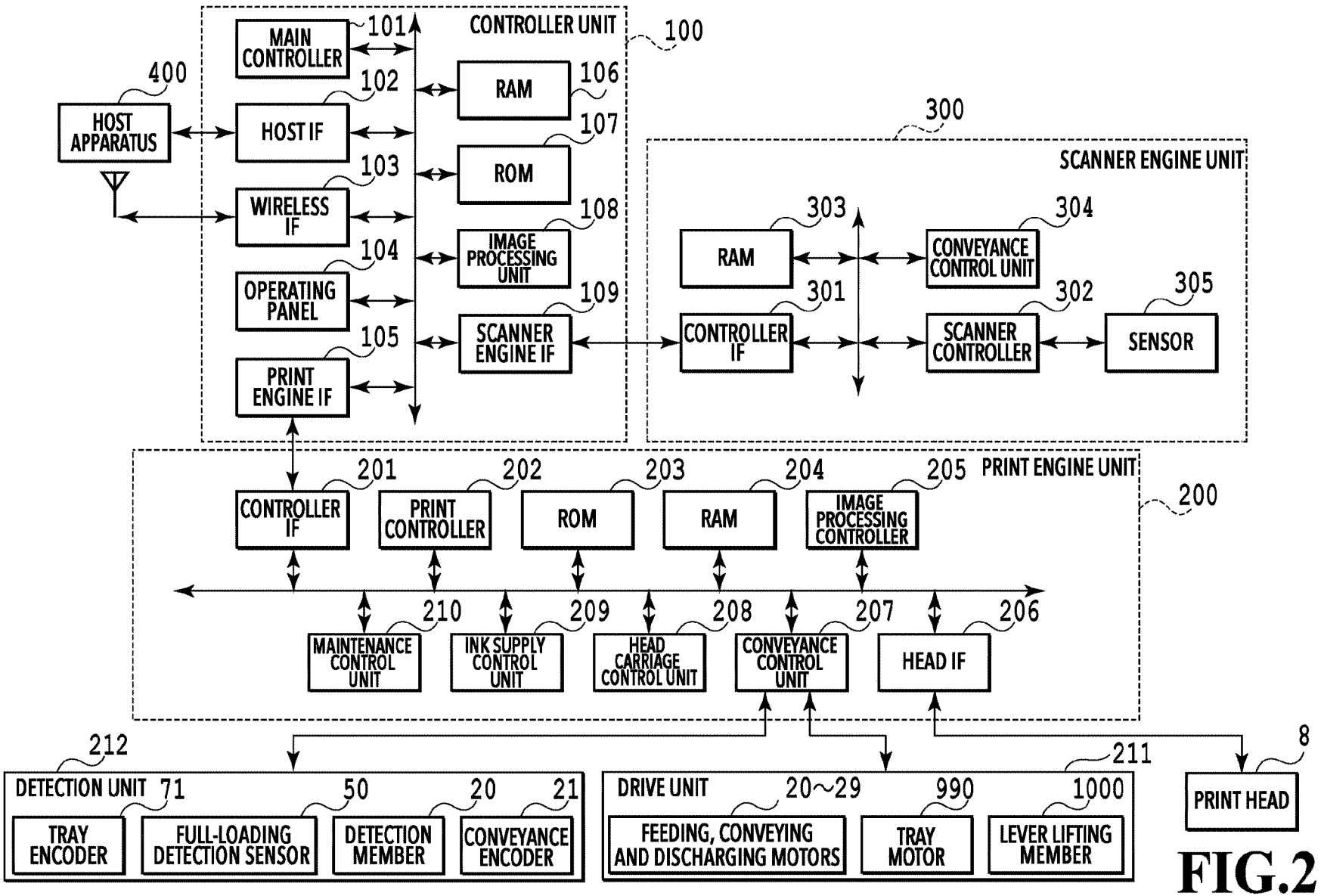
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. The print controller 202 controls conveying and discharging of a print medium S by driving the feeding units 6A and 6B, conveying rollers 7, discharging roller 12, and flapper 11 shown in FIG. 1 as well as a movable tray 950 and a lever 30 for detection of full loading (neither shown in FIG. 1) via a conveyance control unit 207.

The conveyance control unit 207 is connected to a detection unit 212 that detects the conveyance state of a print medium S, and a drive unit 211 that drives a plurality of drive rollers and the discharging tray 13. The detection unit 212 includes detection members 20 for each detecting the presence/absence of a print medium S, a conveyance encoder 21 for detecting the amounts of rotation of the drive rollers, a full-loading detection sensor 50 for detecting full loading of the discharging tray 13, and a tray encoder 71 for detecting the position of the discharging tray 13. The drive unit 211 includes a tray motor 990 for driving the discharging tray 13 and a lever lifting member 1000 connected to a motor (not shown) in addition to a plurality of motors 22 to 29 for feeding, conveying and discharging a print medium S.

The conveyance control unit 207 controls the conveyance of a print medium S by using the drive unit 211 based on the result of detection obtained from the detection unit 212. During the conveyance of a print medium S under control of the conveyance control unit 207, print operation is performed to carry out a printing process by the print head 8 in response to an instruction from the print controller 202. In addition, in a case where a "sorted discharging process" is set in a print command (print job), the conveyance control unit 207 drives the tray motor 990 to sort discharged print medium on the discharging tray 13.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
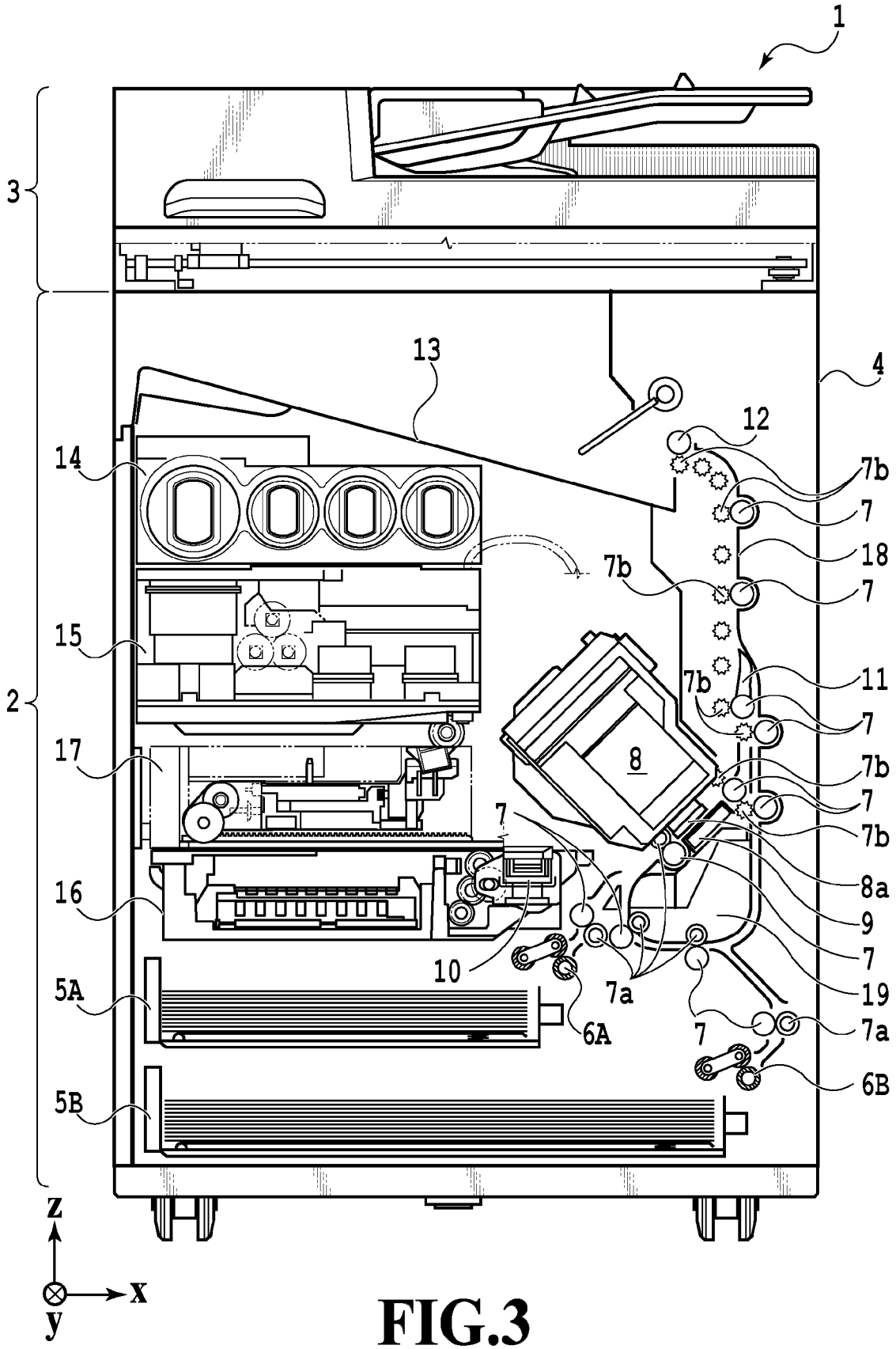
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating a cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
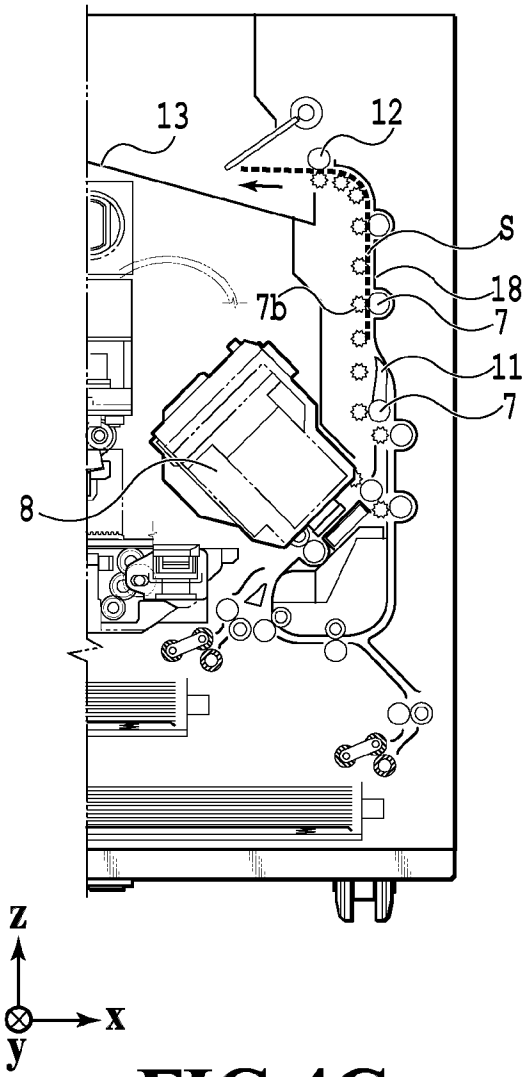
FIGS. 4A to 4C are diagrams showing a conveying path for a print medium fed from a first cassette.
Figure 4B:
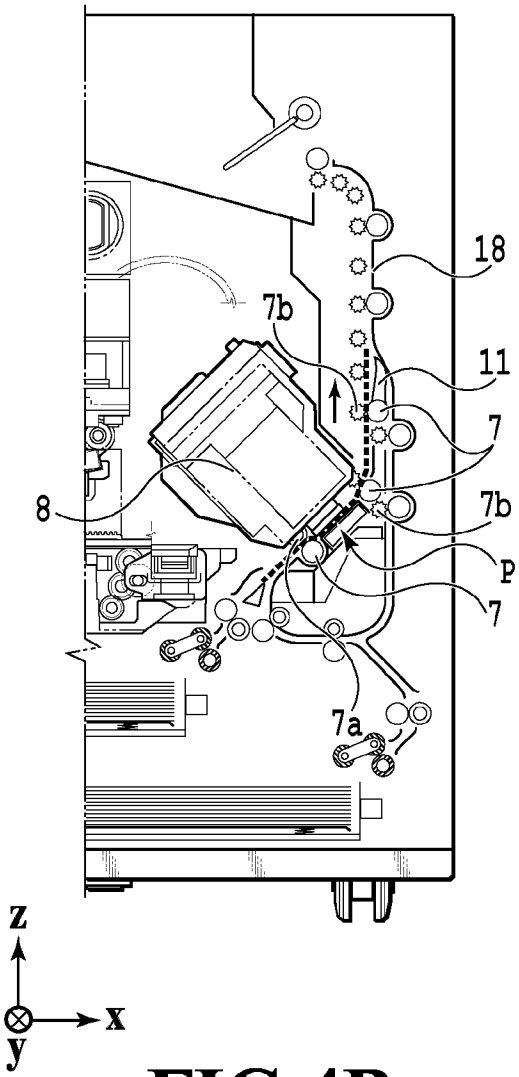
Figure 4A:
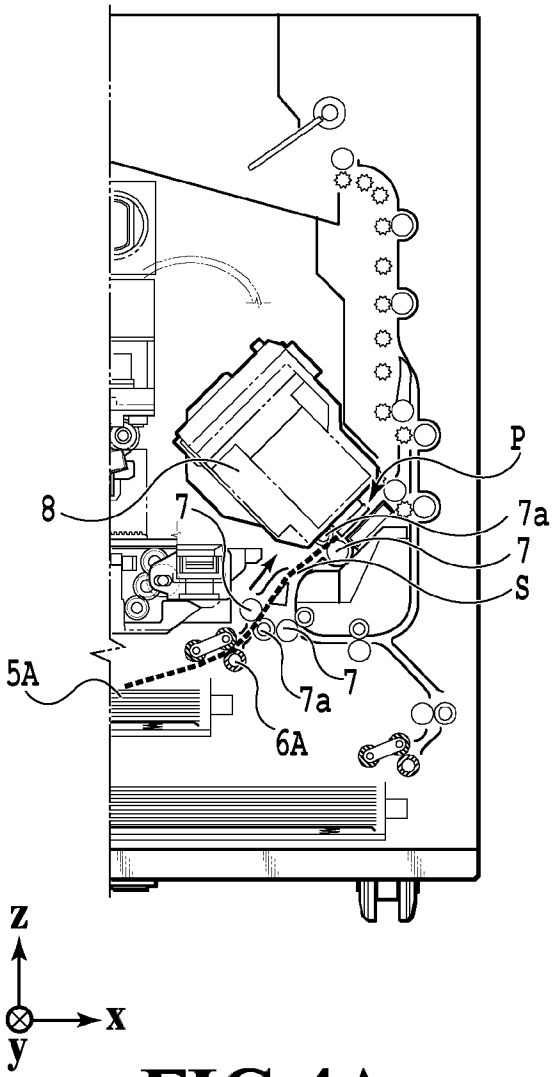

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
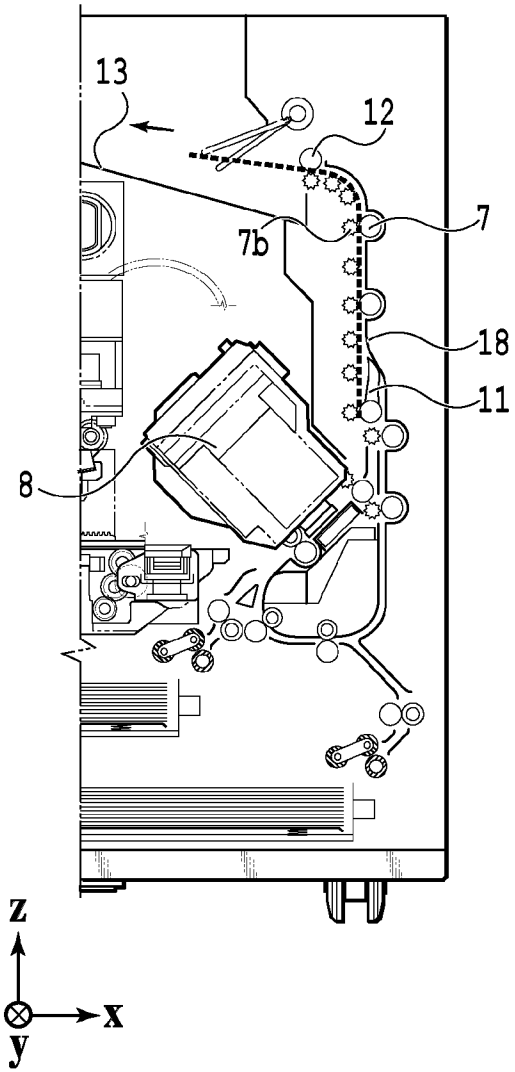
FIGS. 5A to 5C are diagrams showing a conveying path for a print medium fed from a second cassette.
Figure 5B:
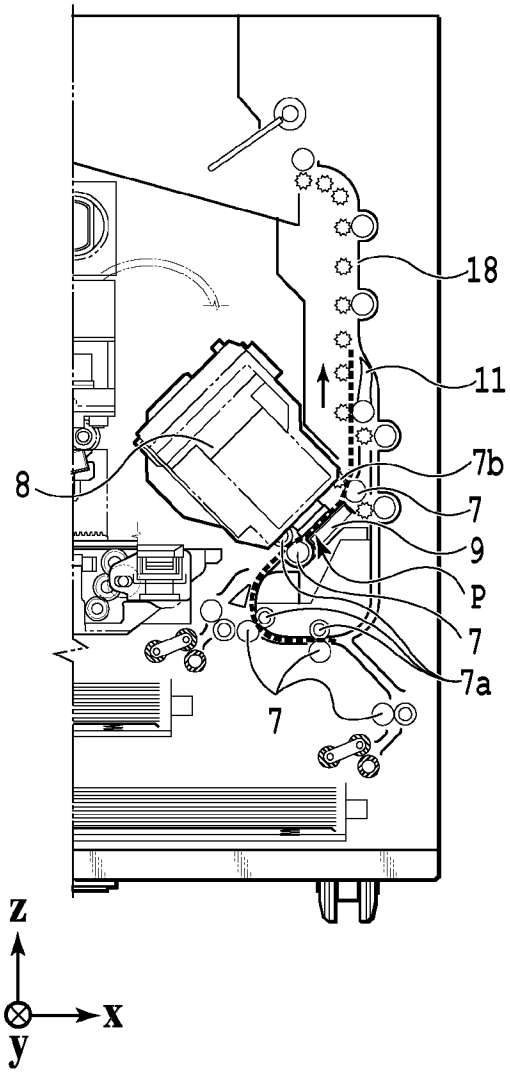
Figure 5A:
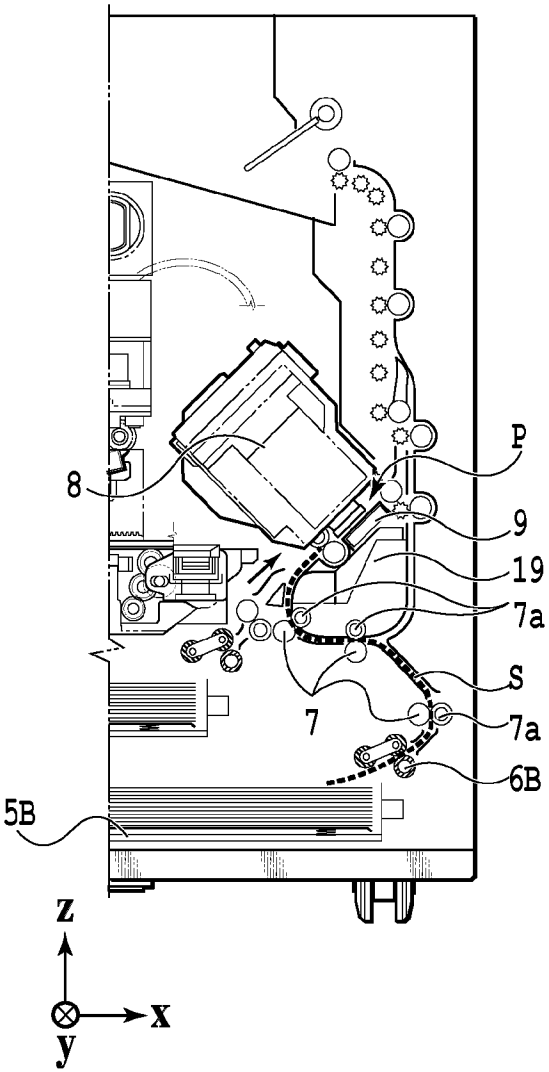

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
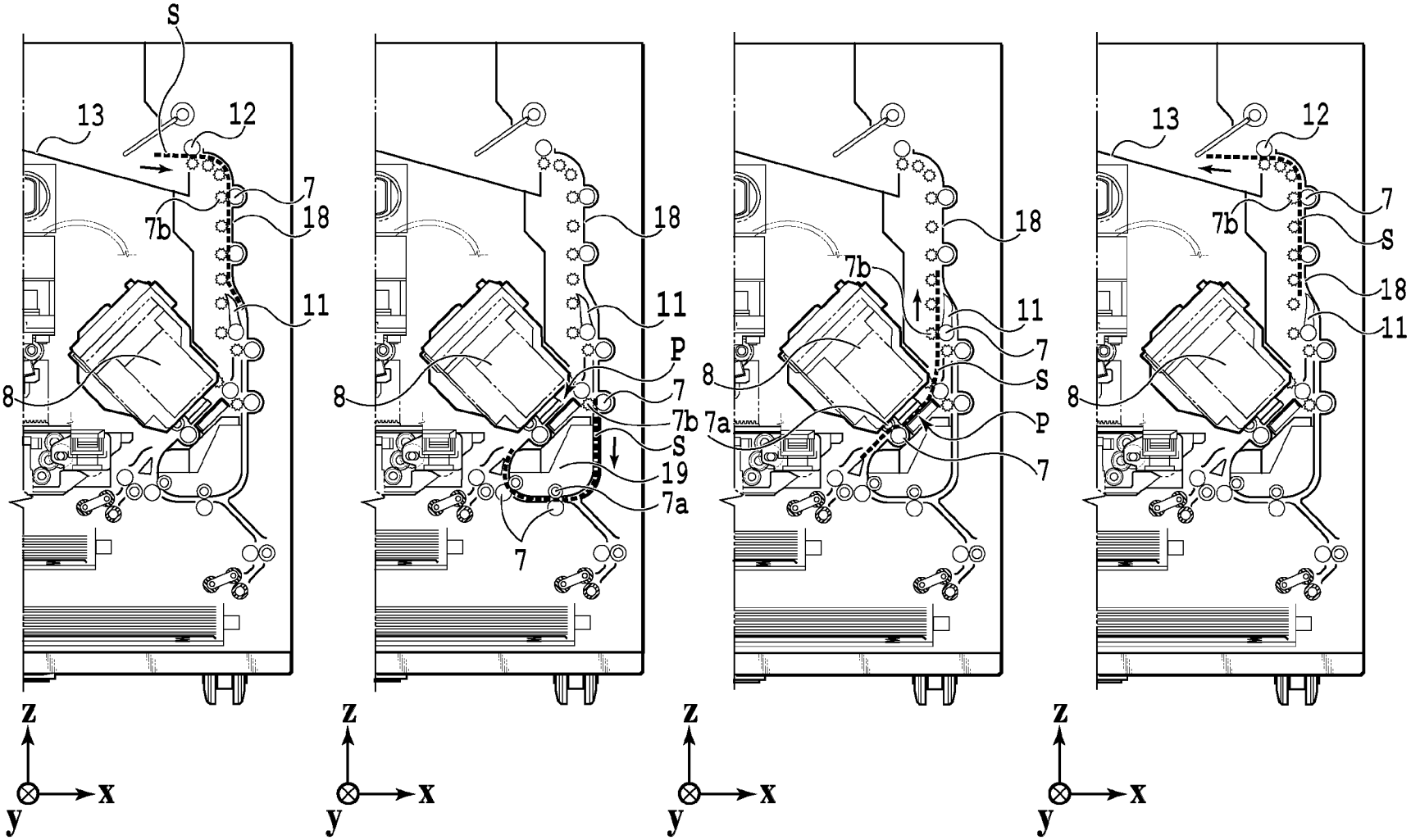
FIGS. 6A to 6D are diagrams showing a conveying path in the case of performing print operation on the back side of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
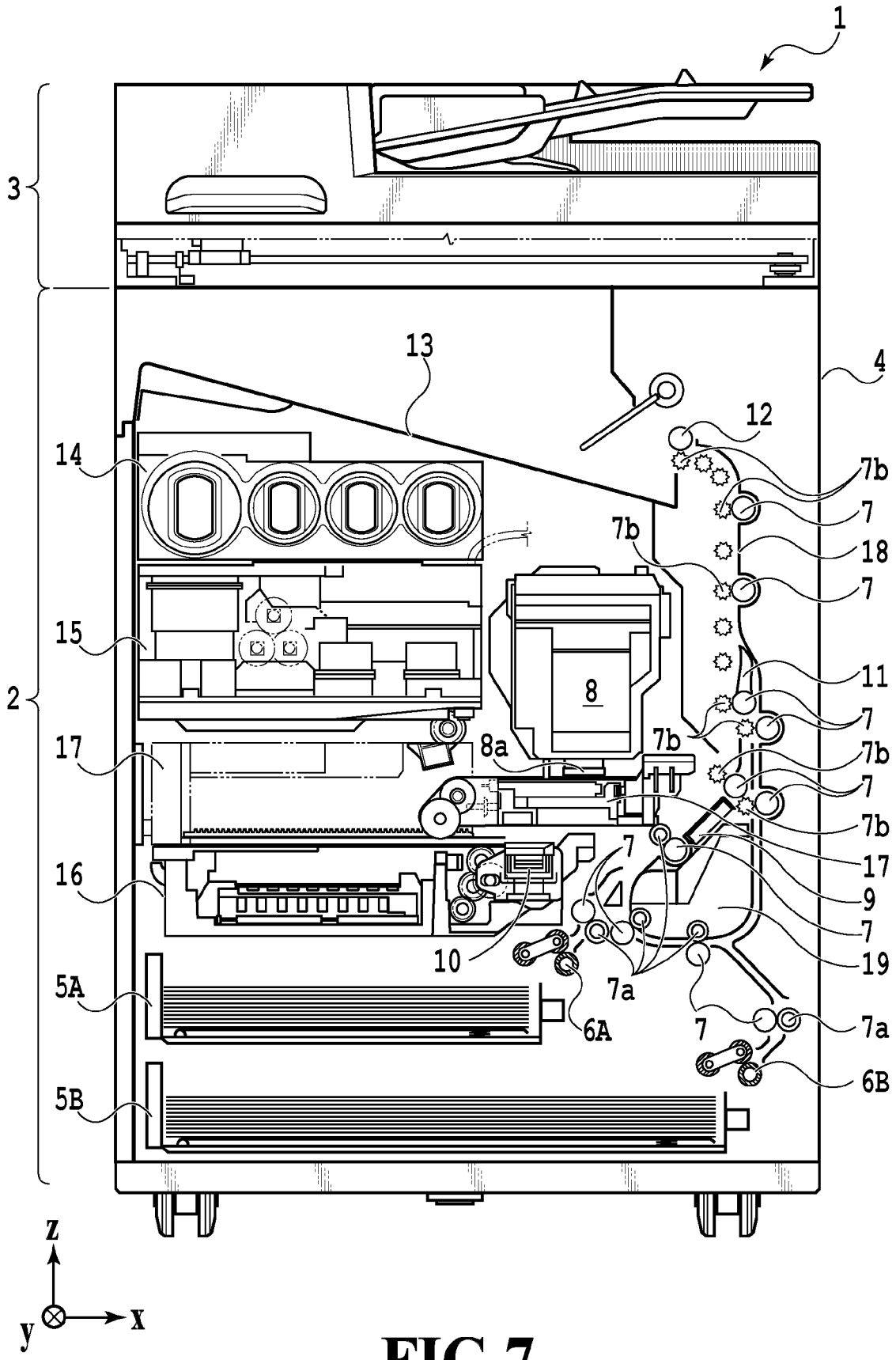
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
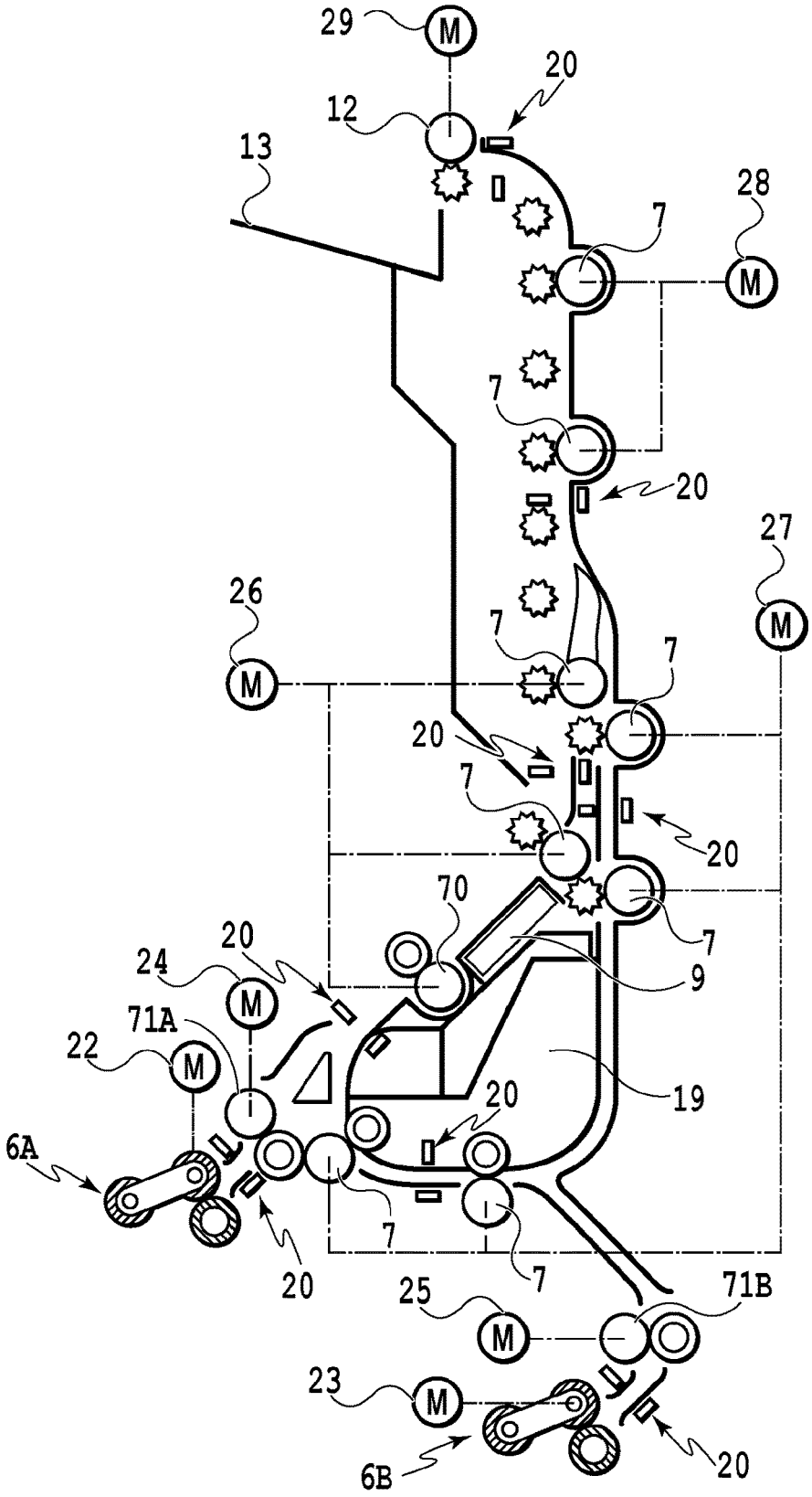
FIG. 8 is a diagram showing the correspondence relation between drive rollers and motors.

FIG. 8 is a diagram showing the correspondence relation between a plurality of motors and drive rollers in the printing apparatus 1. A first feeding motor 22 drives the first feeding unit 6A for feeding a print medium S from the first cassette 5A. A second feeding motor 23 drives the second feeding unit 6B for feeding a print medium S from the second cassette 5B. A first conveying motor 24 drives a first intermediate roller 71A that first conveys a print medium S fed by the first feeding unit 6A. A second conveying motor 25 drives a second intermediate roller 71B that first conveys a print medium S fed by the second feeding unit 6B.

A main conveying motor 26 drives a main conveyance roller 70 that is disposed upstream of the platen 9 and mainly conveys a print medium S which is being printed. The main conveying motor 26 also drives two conveyance rollers 7 that are disposed downstream of the platen 9 and convey, further downstream, a print medium S which is conveyed by the main conveyance roller 70.

A third conveying motor 27 drives two conveyance rollers 7 that convey a print medium S downward whose first side has been subjected to printing. The third conveying motor 27 also drives two conveyance rollers 7 that are disposed along the inner guide 19 and convey to the print head 8 a print medium S which is fed from the second cassette 5B and conveyed toward the second intermediate roller 71B, or a print medium S whose first side has been subjected to printing and which is flipped over.

A fourth conveying motor 28 drives two conveyance rollers 7 that convey upward or downward a print medium S whose printing has been finished. A discharging motor 29 drives the discharging roller 12 that discharges a print medium S whose printing has been finished onto the discharging tray 13. As apparent from above, each of the two feeding motors 22, 23, the five conveying motors 24 to 28, and the discharging motor 29 is associated with one or more drive rollers.

The detection members 20 for each detecting the presence/absence of a print medium S are disposed at eight locations along the conveying path. Each detection member 20 comprises a sensor and a mirror which are disposed to face each other with the conveying path in between; the sensor including a light emitting unit and a light receiving unit is disposed on one side of the conveying path, and the mirror is disposed on the opposite side of the conveying path at a position facing the sensor. Light emitted from the light emitting unit of the sensor is reflected at the mirror, and the presence/absence of a print medium S, that is, passing of the front end or the back end of a print medium S is discriminated by whether the light receiving unit has detected the reflected light.

The conveyance control unit 207 individually drives the feeding motors 22, 23, the conveying motors 24 to 28, and the discharging motor 29 based on the result of detection by each of the detection members 20 and an output value of the encoder that detects the amount of rotation of each drive roller to control the conveyance of the entire apparatus.

Figure 9C:
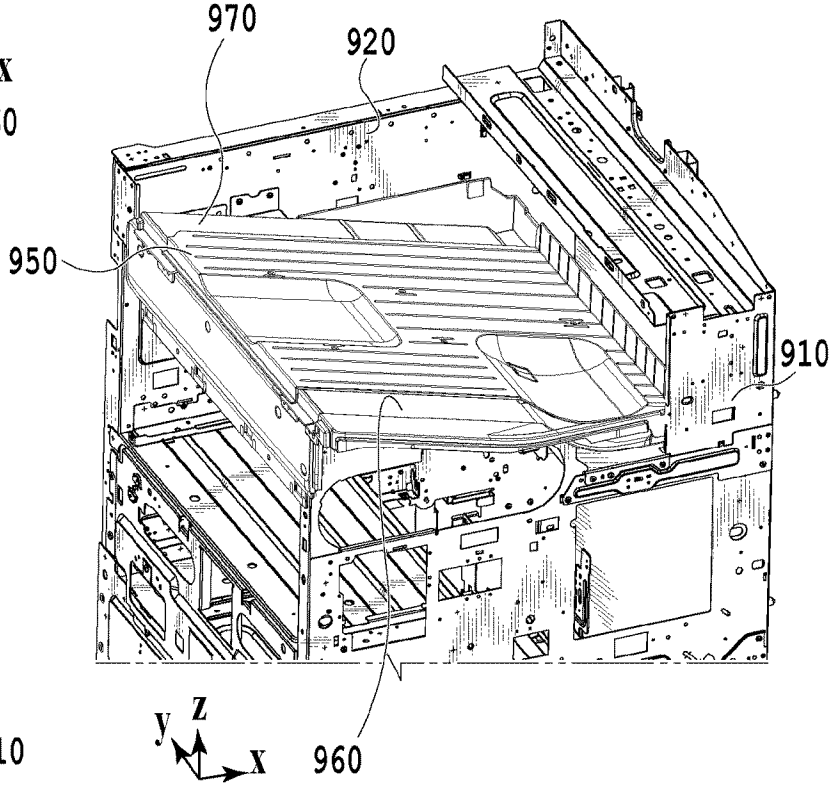
FIGS. 9A to 9C are diagrams showing the configuration and installation position of a discharging tray.
Figure 9B:
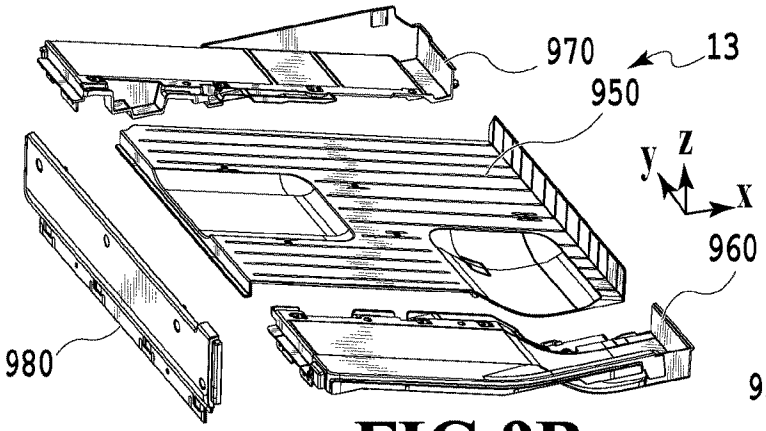
Figure 9A:
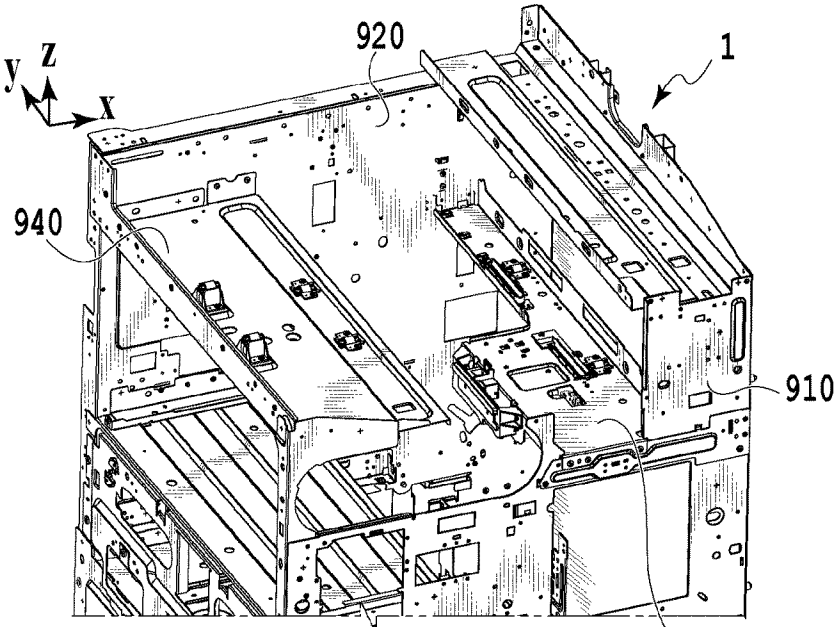

FIGS. 9A to 9C are diagrams for describing the configuration and installation position of the discharging tray 13.

FIG. 9A shows the location of the installation of the discharging tray 13 in the printing apparatus 1. A casing 4 of the printing apparatus 1 that houses an image printing unit includes a first side plate 910 on the near side of the front side (−y-direction side) and a second side plate 920 on the deep side of the front side (+y-direction side). The first side plate 910 and the second side plate 920 are made of sheet metal to secure the rigidness of the entire printing apparatus 1. In addition, a first frame 930 and a second frame 940, which are also made of sheet metal and have surfaces parallel to a horizontal plane, are fixed so as to couple the first side plate 910 to the second side plate 920. The discharging tray 13 according to the present embodiment is mounted between the first side plate 910 and the second side plate 920 and on the first frame 930 and the second frame 940 which are bridged over therebetween.

FIG. 9B is a diagram showing the configuration of the discharging tray 13. The discharging tray 13 includes the movable tray 950, a first fixed tray 960, a second fixed tray 970, and a tray side cover 980.

At the time of assembling the printing apparatus, first, the first fixed tray 960 and the second fixed tray 970 are mounted so as to bridge over the first frame 930 and the second frame 940 of the apparatus body. At this time, the first fixed tray 960 is disposed on the near side to be fixed to the first side plate 910. The second fixed tray 970 is disposed on the deep side to be fixed to the second side plate 920.

Next, the movable tray 950 is likewise mounted to bridge over the first frame 930 and the second frame 940. At this time, the movable tray 950 is mounted to be partially overlap the first fixed tray 960 and the second fixed tray 970 in the y-direction (widthwise direction to be described later) so as to fill the gap between those trays 960 and 970. That is, the first fixed tray 960 supports part of one side of the movable tray 950, and the second fixed tray 970 supports part of the other side of the movable tray 950. After the first fixed tray 960, the second fixed tray 970, and the movable tray 950 are mounted in the above manner, the tray side cover 980 is mounted, thus completing the discharging tray 13 as shown in FIG. 9C.

A print medium S on which an image has been printed is discharged onto this discharging tray 13 in a −x-direction from a +x-direction in the diagram. Hereinafter, the x-direction in the diagram is referred to as "discharging direction," and the y-direction crossing (orthogonal to in the present embodiment) the x-direction is referred to as "widthwise direction." Further, the +x-direction side is referred to as "upstream side in the discharging direction," and the −x-direction side is referred to as "downstream side in the discharging direction."

As shown in FIG. 9C, the discharging tray 13 is inclined so that the upstream side in the discharging direction becomes lower. This is because the second frame 940 located downstream is disposed at a higher position in the vertical direction than the first frame 930 located upstream. Moreover, the movable tray 950 is movable in the widthwise direction while keeping the overlapping relationship with the first fixed tray 960 and the second fixed tray 970.

Figure 10:
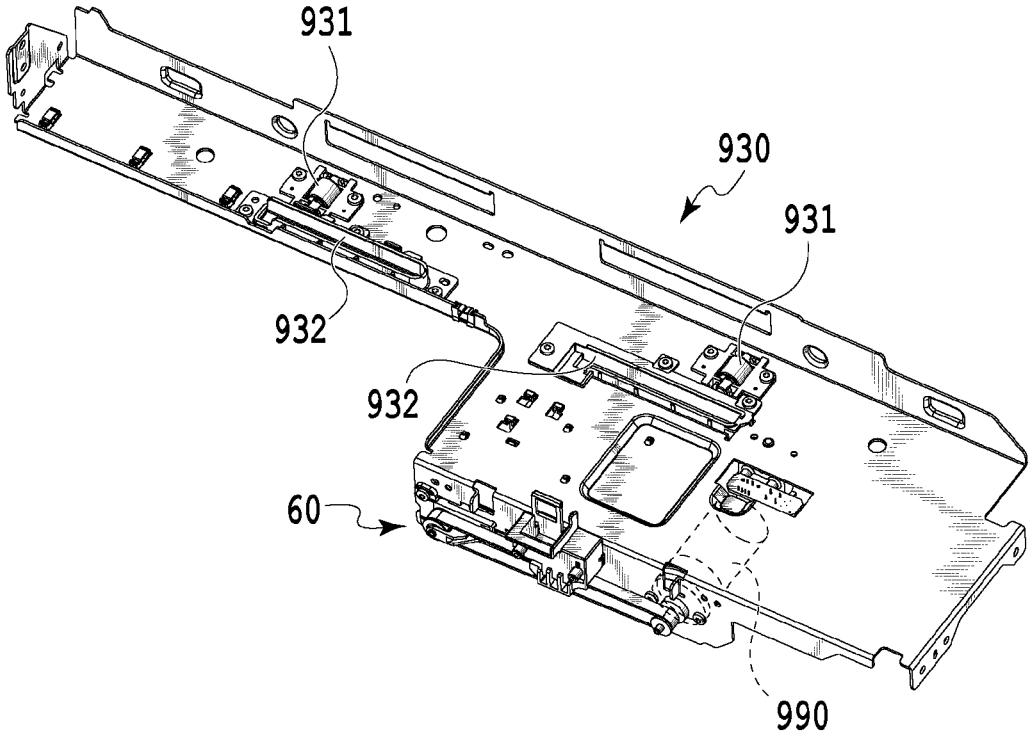
FIG. 10 is an enlarged perspective view of a first frame 930.

FIG. 10 is an enlarged perspective view of the first frame 930. As shown in FIG. 10, the first frame 930 is provided with support members 931 and guide members 932 which contact to the back side of the movable tray 950.

The tray motor 990 which is a drive source for moving the tray is disposed on the back side of the first frame 930, and a drive transmission unit 60 for transmitting drive force of the tray motor 990 to the movable tray 950 is provided on the downstream side surface of the first frame 930. Such a first frame 930 is fixed to the first side plate 910 (see FIGS. 9A to 9C) and the second side plate 920 (see FIGS. 9A to 9C) by mounting surfaces on both sides of the first frame 930, and supports the movable tray 950 as a part of a frame body of the apparatus body.

Figure 11A:
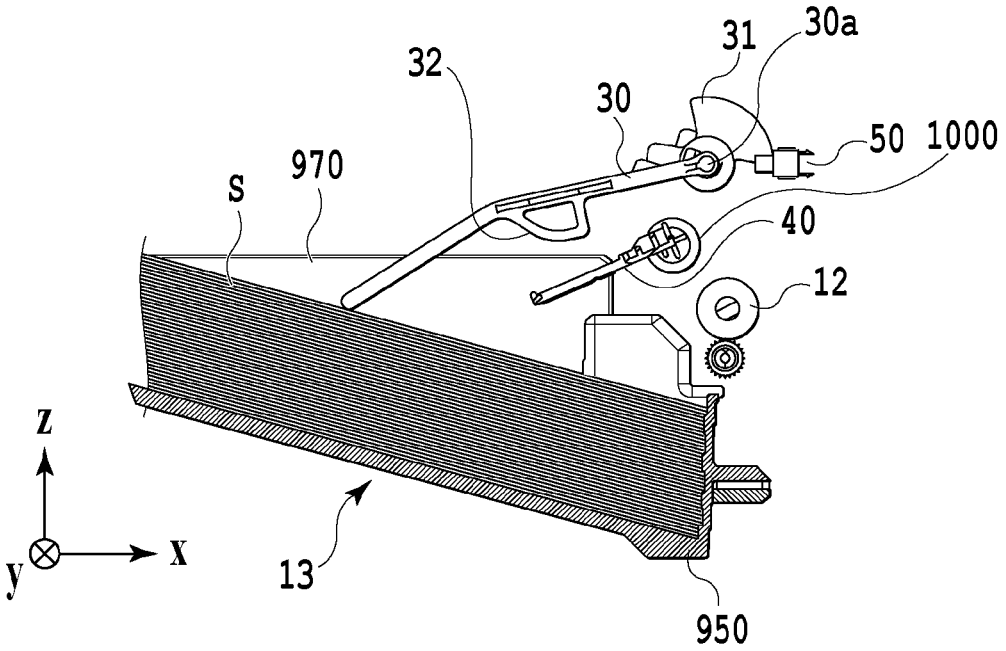
FIGS. 11A and 11B are diagrams for describing a mechanism for detecting full loading.
Figure 11B:
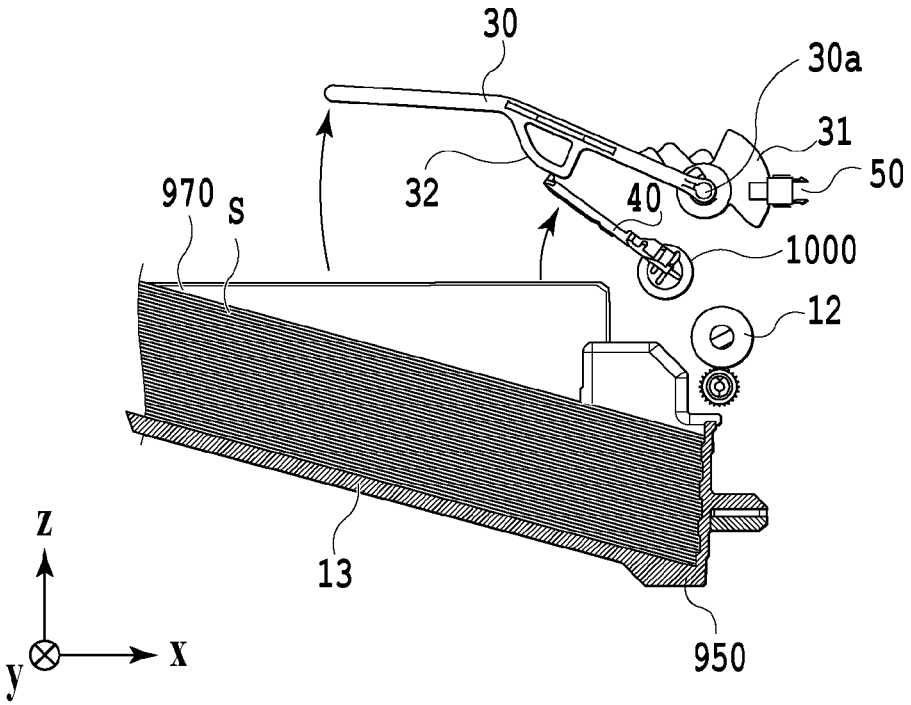

FIGS. 11A and 11B are diagrams for describing a mechanism for detecting full loading on the discharging tray 13. After the rear end of a print medium S discharged from the discharging roller 12 is released from the nip portion of the discharging roller 12, the print medium S is brought close to the upstream side end portion of the movable tray 950 by gravity and stacked with the rear end of the print medium S aligned with the rear ends of the underlying print medium.

A lever 30 rotatable about a rotational axis 30*a* is disposed above the discharging roller 12 in the vertical direction. The lever 30 tends to rotate counterclockwise in the diagrams according to the gravity, and the rotational position of the lever 30 is set at a position where the tip of the lever 30 contacts to the topmost surface of the stack of print medium on the discharging tray 13. That is, in a case where the amount of the stack of print medium is small, the tip of the lever 30 is positioned low, and as the amount of the stack of print medium becomes larger, the tip of the lever 30 is shifted higher. In a case where a new print medium is discharged with the tip of the lever 30 contacting to the stack of print medium as shown in the diagrams, the front end of the print medium S discharged from the nip portion of the discharging roller 12 pushes the lever 30 upward so that the print medium S comes on top of the print medium already stacked.

A light shielding plate 31 which rotates together with the lever 30 is mounted to a rotational axis 30*a* of the lever 30. A full-loading detection sensor 50 including an optical sensor is disposed in part of the rotational path of the light shielding plate 31. In a case where the quantity of print medium on the discharging tray 13 is small, the tip of the lever 30 is positioned low, and the full-loading detection sensor 50 is not blocked by the light shielding plate 31. Under this condition, the conveyance control unit 207 determines that the discharging tray 13 is not fully loaded. In a case where multiple print medium are discharged on the discharging tray 13 so that the tip of the lever 30 rises and the full-loading detection sensor 50 is blocked by the light shielding plate 31 (FIG. 11A), the conveyance control unit 207 determines that the discharging tray 13 is fully loaded.

A lift member 40 rotatable by a lever lifting member 1000 which is a drive source to move the lever 30 is disposed below the lever 30 in the vertical direction. As the lift member 40 rotates clockwise, the lift member 40 contacts to a lever contacting portion 32 to lift the lever 30 upward against the gravity, so that the tip of the lever 30 can be separated from the stack of print medium (FIG. 11B).

Hereinafter, the state where the lift member 40 lifts the lever 30 up and the tip of the lever 30 is evacuated from the stack of print medium or the movable tray is referred to as "evacuation position." Further, the position at which the lift member 40 does not contact the lever 30 and the tip of the lever 30 contacts to or is contactable to the stack of print medium is referred to as "detection position." That is, the conveyance control unit 207 can switch between the "detection position" and the "evacuation position" by driving the lever lifting member 1000.

Figure 12:
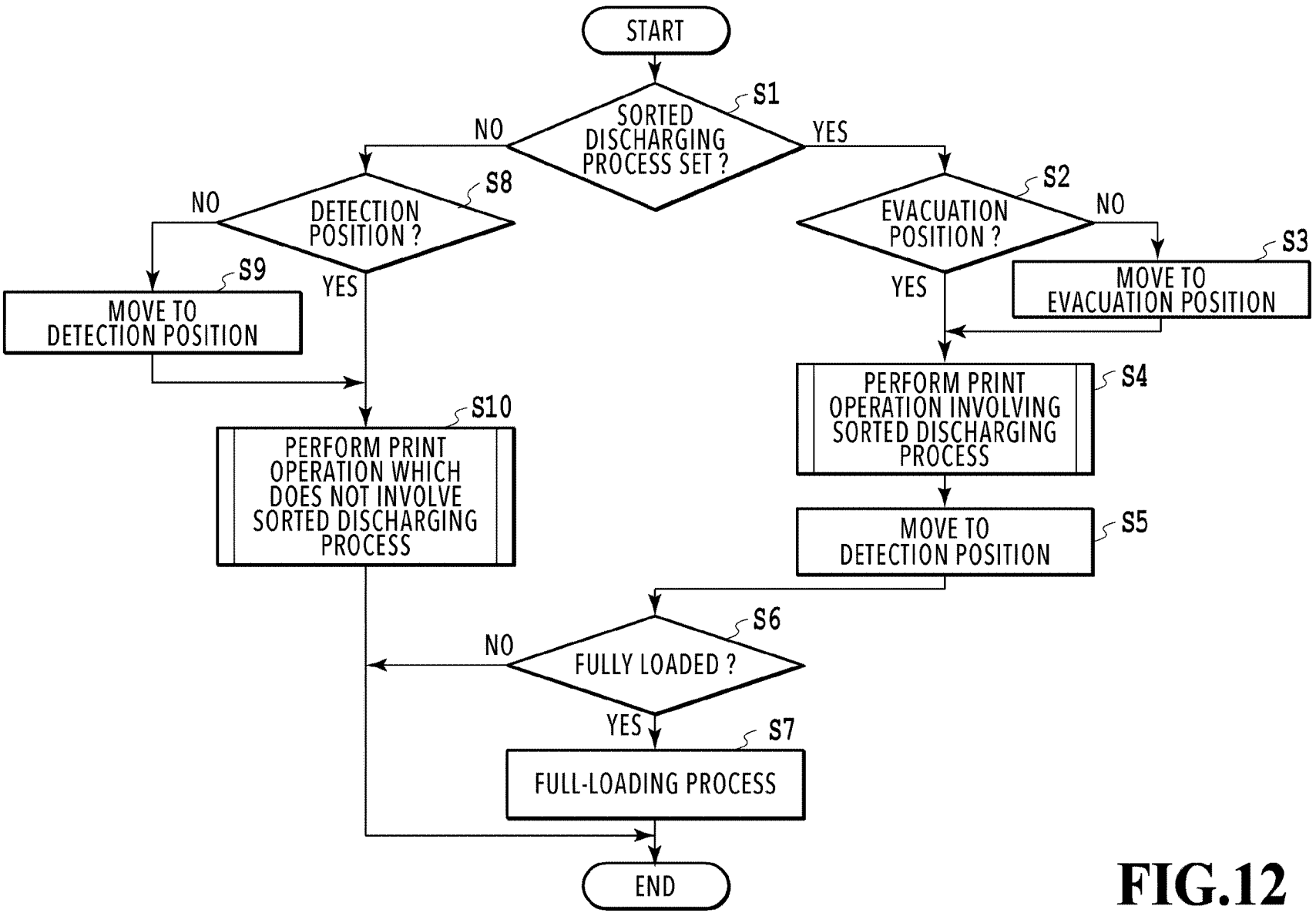
FIG. 12 is a flowchart for processing procedures that are performed at a time of receiving a print command.

It is premised that the printing apparatus 1 according to the present embodiment switches between the "detection position" and the "evacuation position" according to the content of a print command. FIG. 12 is a flowchart for describing processing procedures that are performed by the print controller 202 at a time of receiving a print command.

As this processing is initiated, the print controller 202 determines at S1 whether a "sorted discharging process" is set in the received print command. The "sorted discharging process" used herein refers to a discharging process for aligning print medium at different positions on the discharging tray by moving the movable tray 950 horizontally with respect to the discharging port. In a case where a "sorted discharging process" is set, the print controller 202 proceeds to S2 and determines whether the lever 30 is at the "evacuation position."

In a case where the lever 30 is at the "evacuation position" at S2, the print controller 202 proceeds to S4, and in a case where the lever 30 is not at the "evacuation position," the print controller 202 drives the lever lifting member 1000 to move the lever 30 to the "evacuation position" at S3, and then proceeds to S4.

As S4, the print controller 202 executes print operation while carrying out the "sorted discharging process." In other words, the print controller 202 moves the movable tray 950 to a plurality of discharging positions in the widthwise direction in synchronism with the timing of discharging a plurality of print medium via the conveyance control unit 207. As a result, a plurality of print medium S which are discharged from the discharging port are sorted and stacked at a plurality of different positions on the movable tray 950. In a case where a sequence of print operations is finished, the print controller 202 proceeds to S5 and lifts down the lever 30 to the "detection position."

In a case where a plurality of sets of print medium each consisting of five print medium as a job are to be output, for example, a first set is discharged in a case where the movable tray 950 is at a first position (at the rear or front), and a second set is discharged in a case where the movable tray 950 is at a second position (at the front or rear). Print medium which have been printed in response to a first command are discharged on the movable tray 950 positioned at the first position (at the rear or front), and in a case where a second command comes next, the print medium are discharged with the movable tray 950 being at the second position (at the front or rear).

At S6, the print controller 202 determines whether the discharging tray 13 is fully loaded with print medium. That is, in a case where the full-loading detection sensor 50 is blocked by the light shielding plate 31 based on the output of the full-loading detection sensor 50, the print controller 202 determines that the discharging tray 13 is "fully loaded," and in a case where the full-loading detection sensor 50 is not blocked by the light shielding plate 31, the print controller 202 determines that the discharging tray 13 is "not fully loaded." In the case of determining that the discharging tray 13 is "not fully loaded," this processing is terminated. In the case of determining that the discharging tray 13 is "fully loaded," on the other hand, the print controller 202 proceeds to S7 to perform a predetermined full-loading process, and then terminates this processing. The predetermined full-loading process is a process in which a user is notified that the discharging tray 13 is fully loaded via the operating panel 104, for example, and is recommended to take the print medium from the discharging tray 13.

In the case of determining at S1 that a "sorted discharging process" is not set, the print controller 202 proceeds to S8 and determines whether the lever 30 is at the "detection position."

In a case where the lever 30 is at the "detection position" at S8, the print controller 202 proceeds to S10, and in a case where the lever 30 is not at the "detection position" at S8, the print controller 202 drives the lever lifting member 1000 to lift up the lever 30 to the "detection position" at S9 and then proceeds to S10.

At S10, the print controller 202 executes print operation while performing the normal discharging process not involving sorting. In other words, the print controller 202 discharges a plurality of print medium without moving the movable tray. As a result, a plurality of print medium S discharged consecutively are aligned at the rear ends along the slope of the movable tray 950, and are stacked at the same position on the movable tray 950.

During the print operation at S10, the print controller 202 detects the output value of the full-loading detection sensor 50. The lever 30 contacting to the stack of print medium gradually turns clockwise in the diagrams as the number of print medium stacked on the discharging tray 13 increases. In a case where the light shielding plate 31 reaches the position of the full-loading detection sensor 50, the print controller 202 determines that the discharging tray 13 is fully loaded, stops print operation, and terminates this processing performing the predetermined full-loading process. In a case where the full-loading state is not detected until all print operations are finished, this processing is terminated in a case where the print operation is completed.

According to the foregoing embodiment, in a case where a discharging process involving sorting is set in a print command, the lever 30 is evacuated from the discharging tray 13, under which state a plurality of print medium are discharged while the movable tray 950 is moving in the widthwise direction. Consequently, a plurality of print medium stacked on the discharging tray 13 move without hitting the lever 30, and are aligned at a plurality of positions on the discharging tray 13. In a case where a discharging process involving sorting is not set in a print command, on the other hand, the movable tray 950 comes to rest, and a plurality of print medium are discharged with the lever 30 contacting to the print medium. As a result, a plurality of print medium are aligned and stacked at the same position on the discharging tray 13. According to the present embodiment, therefore, full-loading of the discharging tray can be reliably detected while properly performing a discharging process involving sorting by switching the position of the lever 30 between the "detection position" and the "evacuation position" according to the contents of a print command. In addition, it is possible to avoid a relative movement of the stack of print medium and the tip of the lever in contact with each other, so that misalignment, work-up, scratch or the like of stacked print medium can be prohibited.

Second Embodiment

In the present embodiment, a printing apparatus 1 similar to the printing apparatus according to the first embodiment is also used. The printing apparatus 1 according to the present embodiment performs initialization operation to acquire the position of the origin of the movable tray 950 at an adequate timing in order to accurately manage the moving position of the movable tray 950 in the widthwise direction. According to the present embodiment, first initialization operation and second initialization operation are provided.

The first initialization operation is performed in a case where print operation is initiated after a relatively short non-operation time, such as a case where a new print command is input to the printing apparatus 1 in a standby state. In the standby state, immediate initiation of print operation is demanded, so that the position of the origin of the movable tray 950 needs to be acquired in a relatively short required time in the first initialization operation.

The second initialization operation is performed in a case where print operation is initiated after a relatively long non-operation time, such as a case where a print command is input at the time of power ON or in a sleep state. In a case where the non-operation time becomes long, there is a high possibility that some foreign matter is placed on the moving path of the movable tray 950. Further, in a case where the non-operation time becomes long, the tray motor 990 may rotate due to a cogging variation or the like, or a disturbance such as external force may act on the movable tray 950 to move the movable tray 950. Accordingly, the second initialization operation checks if the movable tray 950 is properly movable over the entire moving range thereof in addition to acquisition of the position of the origin of the movable tray 950.

Figure 13A:
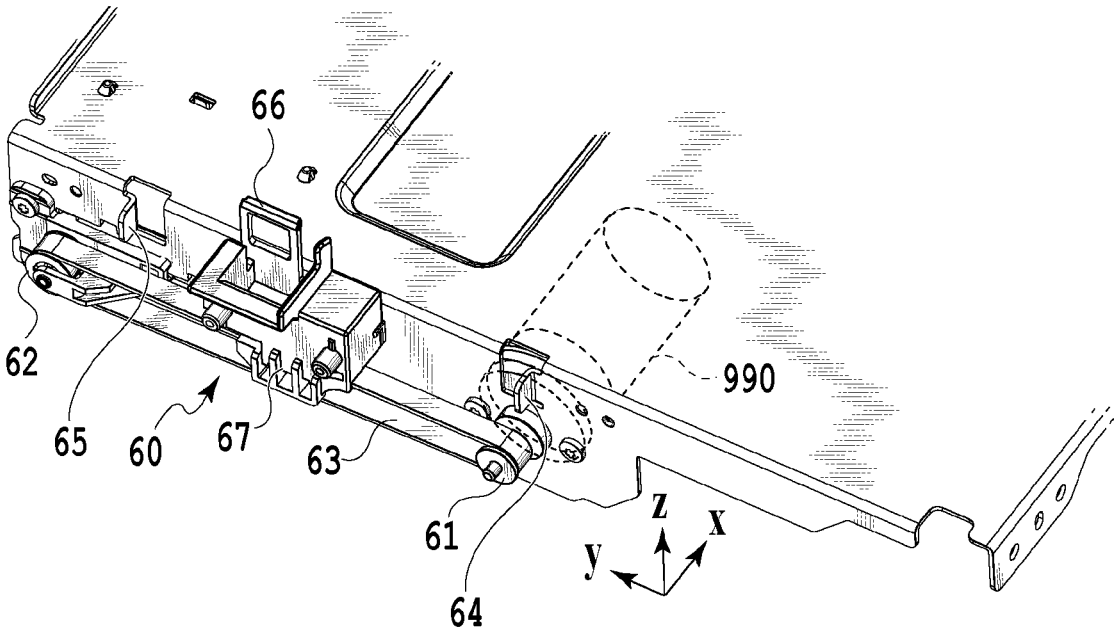
FIGS. 13A to 13C are diagrams for describing a configuration for moving the tray.
Figure 13B:
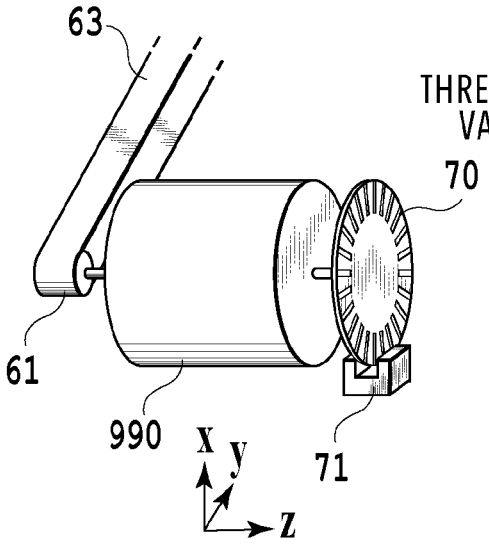
Figure 13C:
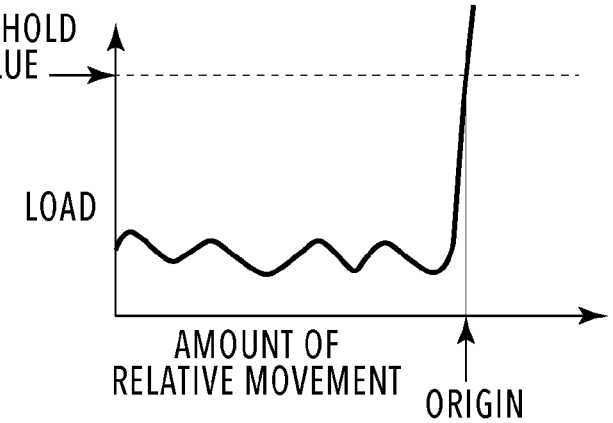

FIGS. 13A to 13C are diagrams for describing a configuration for moving the movable tray 950 and a method of acquiring the position of the origin of the movable tray 950. FIG. 13A is an enlarged view of the drive transmission unit 60 shown in FIG. 10. The drive force of the tray motor 990 which is a DC motor rotates an endless belt 63 via a pulley 61 and an idle pulley 62. A movable-tray coupling part 66 which couples to the back of the movable tray 950 is attached to a linear portion of the endless belt 63. With such a configuration, as the conveyance control unit 207 drives the tray motor 990 in the forward direction and the reverse direction, the movable tray 950 coupled to the movable-tray coupling part 66 reciprocally moves in the widthwise direction (±y-direction in the diagram).

A first contact member 64 and a second contact member 65 are disposed at both end portions of the movable region of the movable-tray coupling part 66 at positions at which the movable-tray coupling part 66 is contactable. In the present embodiment, the position at which the movable-tray coupling part 66 contacts to the first contact member 64 is set as the position of the origin of the movable tray 950.

In a case where the movable-tray coupling part 66 contacts to the first contact member 64 or the second contact member 65 during driving of the tray motor 990, the load of the tray motor 990 increases. In a case where some kind of a foreign matter is present in the moving path of the movable tray 950, the load of the tray motor 990 also increases. According to the present embodiment, the position of the origin of the movable tray 950 is grasped or the presence of a foreign matter is detected by detecting such a load of the tray motor 990. It is to be noted that the load of the tray motor can be measured from the torque, the current value, the amount of movement per unit time, or the like.

As shown in FIG. 13B, a code wheel 70 which rotates coaxially with the tray motor 990 is mounted to the tray motor 990, and an encoder sensor 71 detects regular markings of the code wheel 70. Therefore, the print controller 202 can detect the amount of rotation of the code wheel 70, i.e., the amount of relative movement of the movable tray 950 by counting the number of times the encoder sensor 71 has detected the markings.

FIG. 13C is a graph showing how the load of the tray motor 990 changes with respect to the amount of relative movement. In a case where the movable-tray coupling part 66 contacts to the first contact member 64 or the second contact member 65 during driving of the tray motor 990, the load of the tray motor 990 increases and exceeds a threshold value as shown in the diagram.

With the foregoing configuration, the print controller 202 detects the motor load while driving the tray motor 990 so that the movable-tray coupling part 66 moves toward the first contact member 64. Then, the print controller 202 defines the position at which the motor load exceeds the threshold value as the position of the origin (i.e., defines the marking count value as "0"), for example. After the position of the origin of the movable tray 950 is defined, the print controller 202 controls the absolute position of the movable tray 950 based on the count value from the origin.

In a case where the lever 30 is at the "detection position" even in the foregoing initial operation, the lever 30 may hit the stack of sheets placed on the discharging tray so that the position of the origin may not be acquired accurately. According to the present embodiment, therefore, even in the case of performing initialization operation, the lever 30 is moved to the "evacuation position" prior to this initialization operation.

Figure 14:
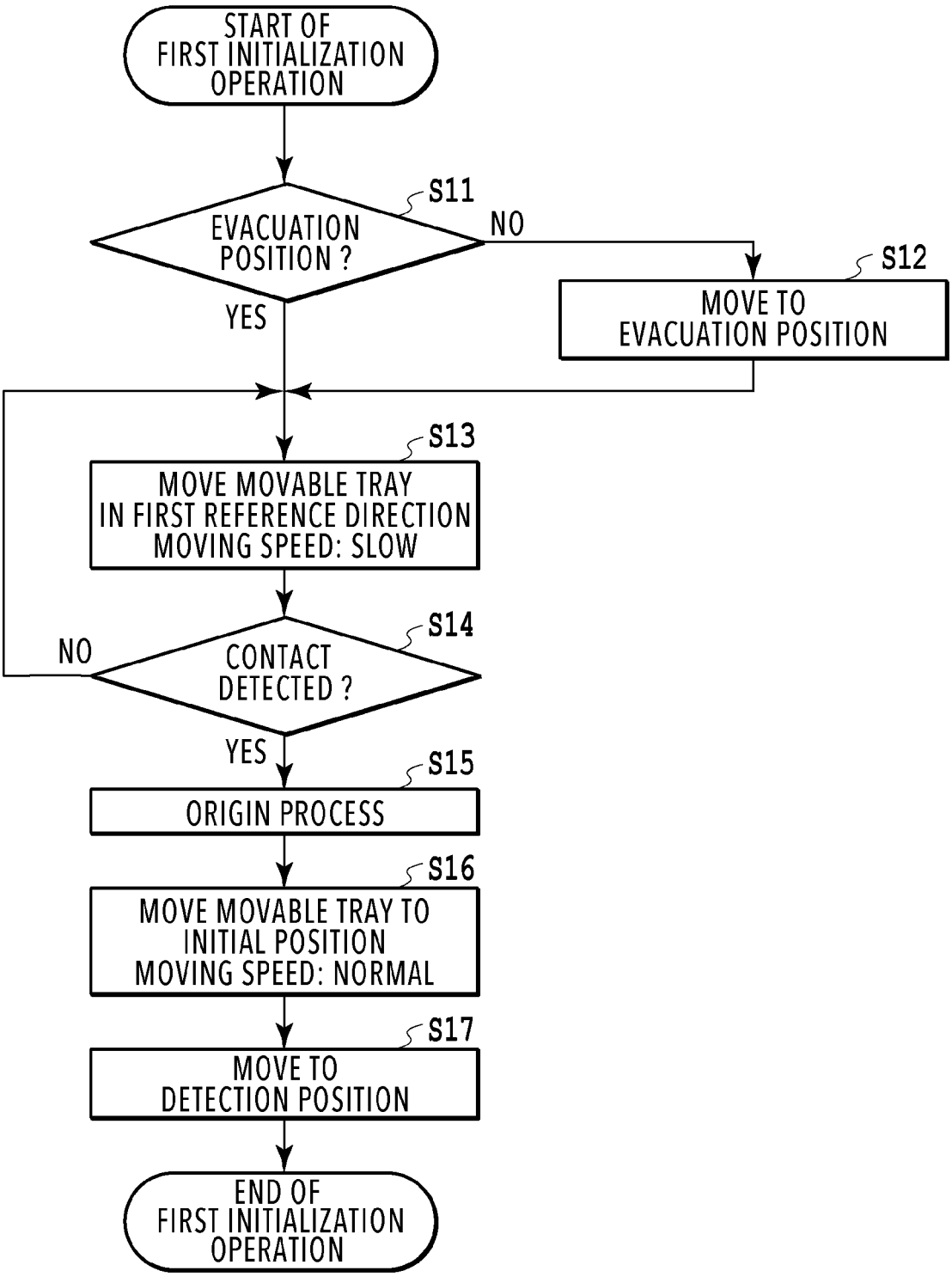
FIG. 14 is a flowchart for describing procedures of first initialization operation.

FIG. 14 is a flowchart for describing procedures of the first initialization operation. This processing is the processing that is executed by the print controller 202 prior to print operation in a case where the printing apparatus 1 in a standby state receives a print command.

As this processing is started, the print controller 202 determines at S11 whether the lever 30 is at the "evacuation position." In a case where the lever 30 is at the "evacuation position," the print controller 202 proceeds to S13. In a case where the lever 30 is not at the "evacuation position" at S11, the print controller 202 proceeds to S12 and drives the lever lifting member 1000 to lift the lever 30 to the "evacuation position," then proceeds to S13.

At S13, the print controller 202 detects the load of the tray motor 990 by driving the tray motor 990 to move the movable tray 950 toward the first contact member 64 (−y-direction). At this time, to prevent the movable tray 950 from being damaged by contact, the print controller 202 moves the movable tray 950 at a speed (100 mm/s or less) slower than the speed at which the "sorted discharging process" is actually executed. Such a movement continues until it is determined at S14 that the motor load has exceeded the threshold value.

In a case where it is determined at S14 that the motor load has exceeded the threshold value, the print controller 202 proceeds to S15 and executes the origin process. Specifically, the print controller 202 resets the marking count value to "0."

At S16, the print controller 202 drives the tray motor 990 to move the movable tray 950 toward the second contact member 65 to a preset initial position. In the present embodiment, the initial position is a position slightly moved toward the second contact member 65 from the position of the origin (the position of the first contact member 64). The distance (count amount) from the position of the origin to the initial position is stored in advance, so that the print controller 202 moves the movable tray 950 until the count value reaches the predetermined count amount.

At S17, the print controller 202 drives the lever lifting member 1000 to lift down the lever 30 to the "detection position." The above completes this processing. The foregoing first initialization operation need not move the movable tray 950 across the entire movable area, which makes it possible to finish the first initialization operation in a relatively short required time and then transition to print operation.

After the first initialization operation, the print controller 202 should execute print operation according to the flowchart described with reference to FIG. 12. At this time, in the print operation at S4, the print controller 202 moves the movable tray 950 at a plurality of positions with reference to the position of the origin acquired in the foregoing first initialization operation in synchronism with the timings of discharging a plurality of print medium. This allows a plurality of print medium S consecutively discharged to be aligned and stacked by a predetermined number at a plurality of different positions.

If the movement of the movable tray 950 based on the same position of the origin is repeated many times, a slight error between the count value of the encoder and the absolute position of the movable tray 950 is accumulated so that the position of the movable tray 950 may not be managed accurately. In such a case, it is preferable to perform the first initialization operation at a timing at which the accumulated error exceeds a tolerance to thereby update the position of the origin even in a case where the printing apparatus 1 upon reception of a print command is not in the standby state.

Figures 15, 15A:
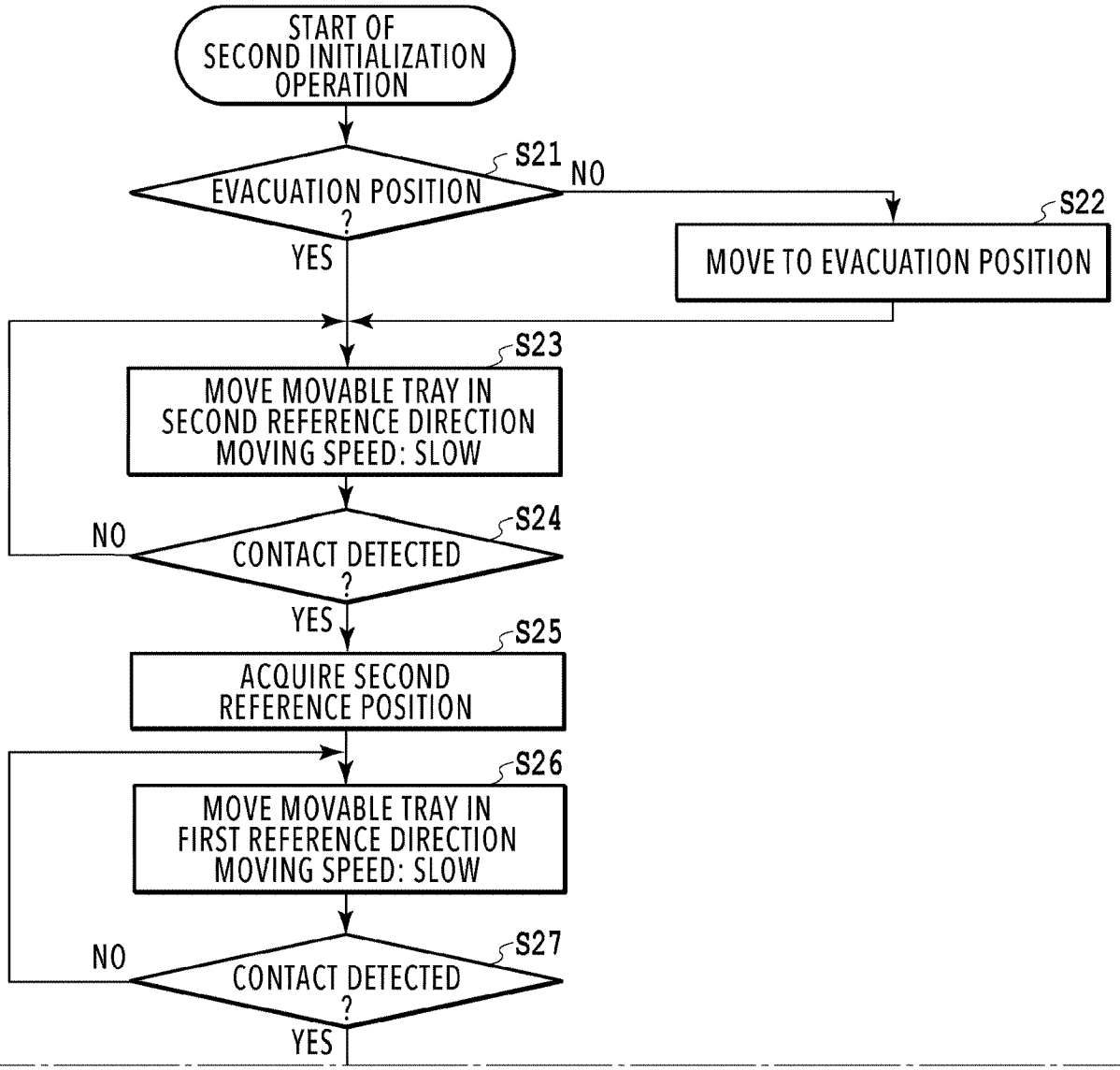
FIG. 15 is a diagram showing the relationship between FIG. 15A and FIG. 15B.
FIG. 15A is a flowchart for describing procedures of second initialization operation.
Figure 15B:
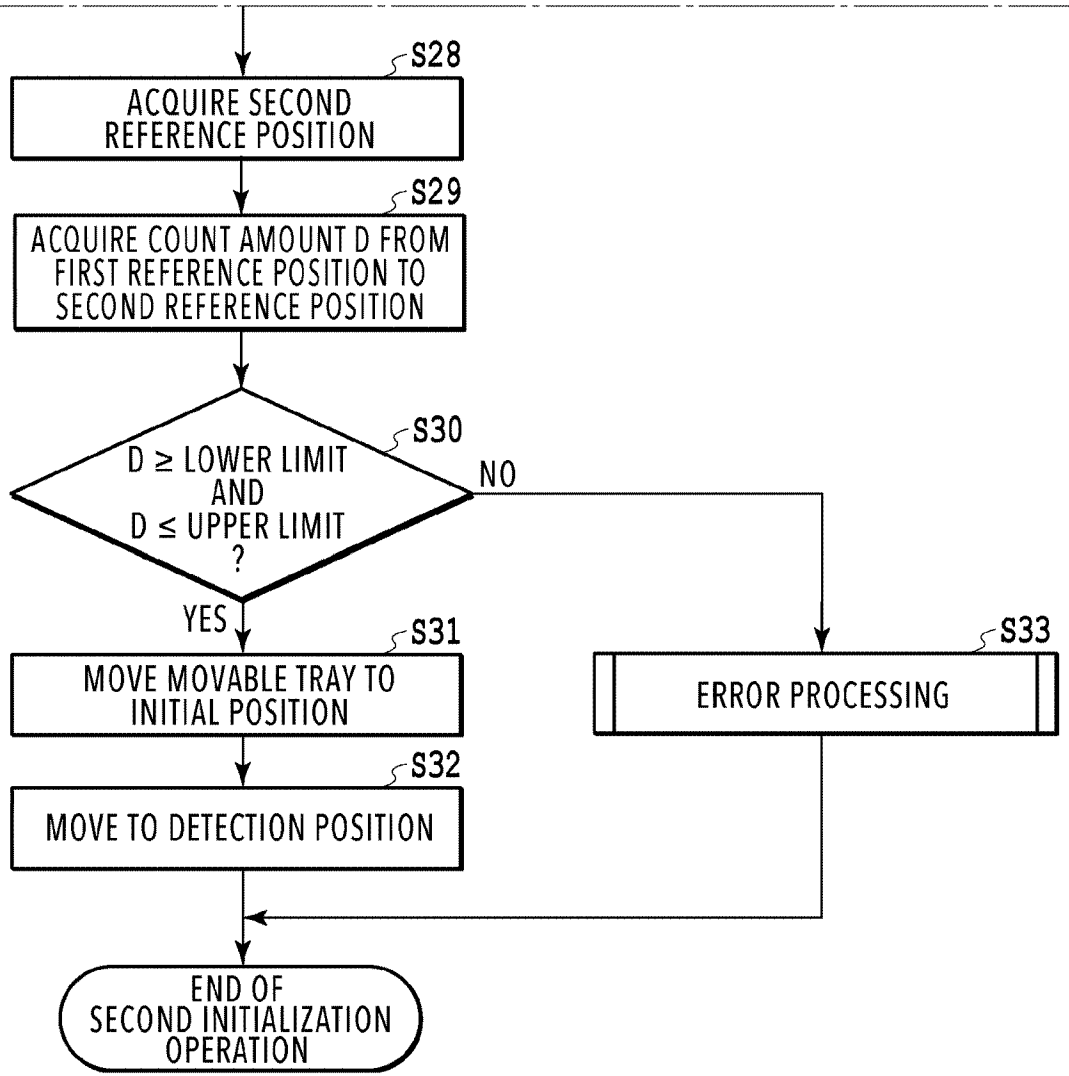
FIG. 15B is a flowchart for describing procedures of second initialization operation.

Next, the second initialization operation will be described. FIG. 15 is a flowchart for describing procedures of the second initialization operation. This processing is the processing that is executed by the print controller 202 prior to print operation in a case where the printing apparatus 1 is supplied with power (powered ON), or receives a print command at a timing at which the printing apparatus 1 is in a sleep state.

As this processing is started, the print controller 202 determines at S21 whether the lever 30 is at the "evacuation position." In a case where the lever 30 is at the "evacuation position," the print controller 202 proceeds to S23. In a case where the lever 30 is not at the "evacuation position" at S21, the print controller 202 drives the lever lifting member 1000 to move the lever 30 to the "evacuation position" at S22, and then proceeds to S23.

At S23, the print controller 202 detects the load of the tray motor 990 by driving the tray motor 990 to move the movable tray 950 toward the second contact member 65 (+y-direction). At this time, the print controller 202 drives the tray motor 990 in such a way that the movable tray 950 moves at a speed (100 mm/s or less) slower than the speed at which the "sorted discharging process" is actually executed. Such a movement continues until it is determined at S24 that the motor load has exceeded the threshold value.

In a case where it is determined at S24 that the motor load has exceeded the threshold value, the print controller 202 proceeds to S25 and acquires a second reference position. Specifically, the print controller 202 stores a current marking count value C2. Even in a case where the cause for the motor load exceeding the threshold value at S24 is not the contact to the second contact member 65, but collision with some kind of a foreign matter, the position of the foreign matter is stored as the second reference position at S25.

At S26, the print controller 202 detects the load of the tray motor 990 by driving the tray motor 990 to move the movable tray 950 toward the first contact member 64 (−y-direction). At S26, the movable tray 950 is moved at a low speed as done at S23.

In a case where it is determined at S27 that the motor load has exceeded the threshold value, the print controller 202 acquires a first reference position (S28). Specifically, the print controller 202 stores a current marking count value C1.

At S29, the print controller 202 calculates a count amount D (=C1−C2) from the second reference position to the first reference position. This count amount D corresponds to the distance between the first reference position detected at S28 and the second reference position detected at S24.

At S30, the print controller 202 determines whether the count amount D lies between a predetermined upper threshold value and a predetermined lower threshold value. In a case where the count amount D does not lie between the upper threshold value and the lower threshold value, it is assumed that some kind of a foreign matter is present between the first contact member 64, which is an expected destination of the movement of the movable tray 950, and the second contact member 65, or that the amount of rotation of the tray motor 990 cannot be accurately detected by the encoder sensor 71. Accordingly, the print controller 202 proceeds to S33 and performs predetermined error processing before terminating this processing. The predetermined error processing is processing to notify a user of the occurrence of an abnormality to the discharging tray 13 and recommend checking of a foreign matter or the like via, for example, the operating panel 104 or the like.

In a case where the print controller 202 determines at S30 that the count amount D lies between the upper threshold value and the lower threshold value, the print controller 202 proceeds to S31 to set the first reference position as the origin, and then moves the movable tray 950 to the initial position. Specifically, the print controller 202 resets the marking count value at the first reference position (sets it to "0"). Then, the print controller 202 drives the tray motor 990 again to move the movable tray 950 toward the second contact member 65 to the initial position.

At S32, the print controller 202 drives the lever lifting member 1000 to lift down the lever 30 to the "detection position." The above completes this processing. The foregoing second initialization operation can check the entire movable area of the movable tray 950, which takes some time, thus making it possible to improve the reliability of subsequent operation involving horizontal movement of the discharging tray 13.

Although the first reference position is acquired after acquisition of the second reference position in the flowchart of FIG. 15, this order may be reversed.

According to the foregoing embodiment, in the first initialization operation as well as in the second initialization operation, acquisition of the position of the origin and checking the moving path are performed after the lever 30 is evacuated to the "evacuation position." This makes it possible to reliably perform initialization operation and improve the reliability of the "sorted discharging process" that follows the initialization operation.

Although the position of the origin is acquired by detecting the motor load at the time the movable-tray coupling part 66 contacts to a contact member in the foregoing embodiment, the present invention is not limited to such a mode. For example, an optical sensor may be provided at a position to be a reference so that the position of the origin may be acquired at a timing at which the light shielding plate mounted to the movable tray 950 blocks the optical sensor. As long as the reference position or a foreign matter can be detected, an electronic approach or a magnetic approach besides such an optical approach can be adopted.

Although the above has described two initialization operations, namely the first and second initialization operations, a further initialization operation may be provided. In addition, although the position of the origin and the initial position are separately provided in the foregoing embodiment, the position of the origin may be set as the initial position. In this case, the process of moving the movable tray 950 to the initial position after performing the origin process may be omitted.

OTHER EMBODIMENTS

The present invention is not limited to evacuation of the lever 30 immediately before print operation or initialization operation as in the first embodiment or the second embodiment. At the time operation involving movement of the movable tray 950 is performed, the lever should be moved to the evacuation position prior to that operation. At this time, the timing at which the lever 30 is moved to the evacuation position may be immediately before the printing apparatus becomes non-operational (e.g., immediately after completion of discharging, immediately prior to powering off, or immediately prior to transition to a sleep state) as well as immediately prior to the above operation. Any image printing apparatus that is configured to be able to perform the "sorted discharging process" and perform operation involving movement of the movable tray 950 after confirming that the lever 30 is at the evacuation position is encompassed within the technical scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-104693, filed May 31, 2018, which is hereby incorporated by reference wherein in its entirety.

What is claimed is:

1. An image printing apparatus comprising:

a print unit configured to print an image on a print medium;

a tray configured to receive the print medium on which an image is printed by the print unit and which is discharged in a first direction;

a discharging unit configured to discharge the print medium, on which an image is printed by the print unit, to the tray;

a tray moving unit configured to move the tray in a second direction crossing the first direction;

a contact member configured to contact the print medium stacked on the tray and be rotatable according to an amount of stacking between a first position at which the contact member is contactable to the stacked print medium and a second position at which the contact member is separated from the stacked print medium in a direction for stacking the print medium on the tray;

a contact member moving unit configured to move the contact member; and a control unit configured to control the tray moving unit and the contact member moving unit, wherein the control unit is capable of executing:

a first mode of causing the discharging unit to discharge the print medium to the tray without causing the tray moving unit to move the tray with the contact member being at the first position, and a second mode of causing the tray moving unit to, with the contact member being at the second position, move the tray in the second direction associated with discharge of a print medium by the discharging unit while causing the print unit to print an image.

2. The image printing apparatus according to claim 1, further comprising a full-loading detection unit configured to detect full loading of the print medium on the tray based on a rotational position of the contact member contacting the stacked print medium at the first position, wherein in a case where the full-loading detection unit detects full loading, the control unit causes the print unit to stop print operation.

3. The image printing apparatus according to claim 1, wherein in the second mode, the control unit causes the contact member moving unit to move the contact member to the first position from the second position after movement of the tray is completed.

4. The image printing apparatus according to claim 1, wherein the control unit performs an initialization operation to acquire a position of origin of a moving area by causing the tray moving unit to move the tray in the second direction.

5. The image printing apparatus according to claim 4, wherein the initialization operation includes first initialization operation in which the tray moves across a part of the moving area, and second initialization operation in which the tray moves across the entire moving area.

6. The image printing apparatus according to claim 1, wherein the print unit is a full-line type inkjet print head that is disposed under the tray in a vertical direction and ejects ink according to image data.

7. The image printing apparatus according to claim 1, wherein the second direction is not perpendicular to the first direction.

8. The image printing apparatus according to claim 1, wherein the control unit controls the tray moving unit and the discharging unit so that the print medium are aligned and stacked by a predetermined number at a plurality of different positions on the tray.

9. A control method for an image printing apparatus comprising a print unit configured to print an image on a print medium, a tray configured to receive a print medium on which an image is printed by the print unit and which is discharged in a first direction, a discharging unit configured to discharge the print medium on which an image is printed by the print unit to the tray and a contact member configured to contact the print medium stacked on the tray and be rotatable according to an amount of stacking between a first position at which the contact member is contactable to the stacked print medium and a second position at which the contact member is separated from the stacked print medium in a direction for stacking the print medium on the tray, the control method comprising:

switching between a first mode and a second mode, the first mode being a mode of causing the discharging unit to discharge the print medium to the tray without causing the tray moving unit to move the tray with the contact member being at the first position, and the second mode being a mode of causing a tray moving unit to, with the contact member being at the second position, move the tray in the second direction associated with discharge of a print medium by the discharging unit while causing the print unit to print an image.

10. The control method according to claim 9, further comprising detecting full loading of the print medium on the tray based on a rotational position of the contact member contacting to the stacked print medium at the first position, wherein in a case where full loading is detected in the detecting full loading, the print unit is caused to stop print operation.

11. The control method according to claim 10, wherein in the second mode, the contact member is moved to the first position from the second position after movement of the tray is completed.

12. The control method according to claim 9, wherein an initialization operation to acquire a position of origin of a moving area is performed by moving the tray in the second direction.

13. The control method according to claim 12, wherein the initialization operation includes first initialization operation in which the tray moves across a part of the moving area, and second initialization operation in which the tray moves across the entire moving area.

14. A medium discharging apparatus comprising:

a tray configured to receive a medium which is discharged in a first direction;

a discharging unit configured to discharge a medium to the tray;

a tray moving unit configured to move a tray for receiving a medium discharged in a first direction, in a second direction crossing the first direction;

a contact member configured to contact the medium stacked on the tray and rotatable according to an amount of stacking between a first position at which the contact member is contactable to the stacked medium and a second position at which the contact member is separated from the stacked medium in a direction for stacking the medium on the tray;

a contact member moving unit configured to move the contact member; and a control unit configured to control the tray moving unit and the contact member moving unit, wherein the control unit is capable of executing:

a first mode of causing the discharging unit to discharge the medium to the tray without causing the tray moving unit to move the tray with the contact member being at the first position, and a second mode of causing the tray moving unit to, with the contact member being at the second position, move the tray in the second direction associated with discharge of the medium by the discharging unit.

15. The medium discharging apparatus according to claim 14, further comprising a full-loading detection unit configured to detect full loading of the medium on the tray based on a rotational position of the contact member contacting to the stacked medium at the first position, wherein the discharging unit discharge the medium on which an image is printed by a print unit to the tray, and wherein in a case where the full-loading detection unit detects full loading, the control unit causes the print unit to stop print operation.

16. The medium discharging apparatus according to claim 14, wherein in the second mode, the control unit causes the contact member moving unit to move the contact member to the first position from the second position after movement of the tray is completed.

17. The medium discharging apparatus according to claim 14, wherein the control unit performs an initialization operation to acquire a position of origin of a moving area by causing the tray moving unit to move the tray in the second direction.

18. The medium discharging apparatus according to claim 17, wherein the initialization operation includes a first initialization operation in which the tray moves across a part of the moving area, and a second initialization operation in which the tray moves across the entire moving area.

19. The medium discharging apparatus according to claim 14, wherein the control unit controls the tray moving unit and the discharging unit so that the print medium are aligned and stacked by a predetermined number at a plurality of different positions on the tray.

* * * * *